United States Patent [19]

Cziment

[11] 4,392,186

[45] Jul. 5, 1983

[54] KEY WITH LIGHT IN HANDLE

[76] Inventor: Avi Cziment, 6732 de Vimy Ave., Montreal, Quebec, Canada

[21] Appl. No.: 216,443

[22] Filed: Dec. 15, 1980

[51] Int. Cl.[3] ..... F21V 33/00

[52] U.S. Cl. ..... 362/116; 362/189; 362/205

[58] Field of Search ..... 362/116, 189, 205

[56] References Cited

U.S. PATENT DOCUMENTS 4,276,582 6/1981 Burnett ..... 362/116

*Primary Examiner*—Donald P. Walsh

[57] ABSTRACT

A key handle comprising a housing for securement to a key. The housing has a base and a cover member defining an internal chamber therebetween. A switch member is retained in the chamber and has flexible guide means to position a first terminal of a battery in the chamber against a contact element in electrical contact with a first terminal of a lamp retainable in the chamber to direct light outwardly of the housing in the direction of the key. The flexible guide means further biases the battery and a second terminal of the battery away from a further contact element in contact with a second terminal of the lamp. The switch member has an actuable portion accessible from the exterior of the housing to displace the battery against the flexible guide means whereby the second terminal of the battery is positioned in electrical contact with the further contact element to cause an electric current to flow through the lamp and cause it to light.

8 Claims, 6 Drawing Figures

KEY WITH LIGHT IN HANDLE

BACKGROUND OF INVENTION (a) Field of the Invention

The present invention relates to a key handle which is securable to a shaft portion of a key which is adapted to be retained in the handle and wherein a lamp is mounted in the handle and actuable by a switch exteriorly of the handle to direct light along the key shaft.

(b) Description of Prior Art

Various types of keys are known wherein a lamp is mounted in a key handle to direct light against the shaft portion of the key. However, some of these known structures require numerous parts making the assembly difficult and sensitive when the key handle is dismantled. This is to say, the parts are loosely held and some of these being fairly small in size are easily lost, rendering the switch inoperable. Furthermore, many such key structures are not adaptable to all types of keys and require keys having specific handle configurations or having particular shaft sizes. Such type of keys are known and reference is made to U.S. Pat. Nos. 3,085,149 (Giwosky); 3,310,668 (Schwartz); and 3,863,062 (Caron), illustrating key structures of this type.

SUMMARY OF INVENTION

It is a feature of the present invention to provide an improved key structure wherein the handle consists of very few parts and which is easily adaptable to any size keys and, more particularly, but not exclusively, to keys utilized for the ignition of automobiles.

A further feature of the present invention is to provide a novel key handle design which is easy to construct and assemble and which utilizes very few parts with the key shaft itself acting as an electrical contact.

According to the above features, from a broad aspect, the present invention provides a key handle comprising a housing for securement to a key. The housing has a base and a cover member defining an internal chamber therebetween. A key shaft retention cavity is provided between the base and cover member to removably retain a connecting end of a key shaft. A switch member is retained in the chamber and has flexible guide means to position a first terminal of a battery in the chamber against a contact element in electrical contact with a first terminal of a lamp retainable in the chamber to direct light outwardly of the housing in the direction of the key. The flexible guide means further biases the battery and a second terminal of the battery away from a further contact element in contact with a second terminal of the lamp. The switch member has an actuable portion accessible from the exterior of the housing to displace the battery against the flexible guide means whereby the second terminal of the battery is positioned in electrical contact with the further contact element to cause an electric current to flow through the lamp and cause it to light.

BRIEF DESCRIPTION OF DRAWINGS

A preferred embodiment of the present invention will now be described with reference to an example thereof illustrated in the accompanying drawings in which.

DESCRIPTION OF PREFERRED EMBODIMENTS

Figure 1:
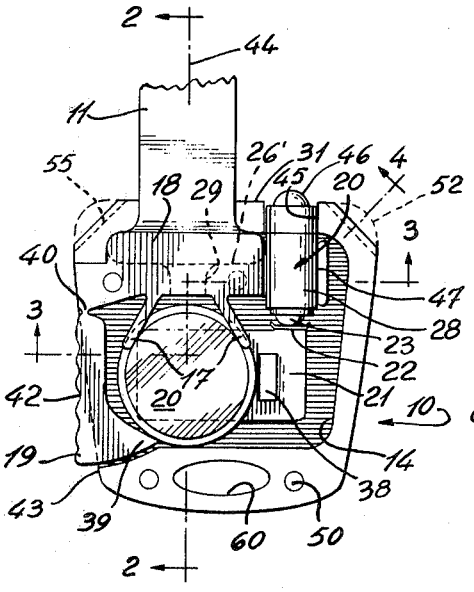
FIG. 1 is a plan view showing the key handle with the cover removed and showing a portion of the key shaft secured therein.
Figure 2:
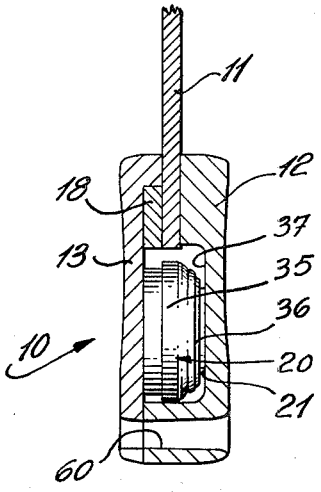
FIG. 2 is a section view along section lines 2—2 of FIG. 1.
Figure 3:
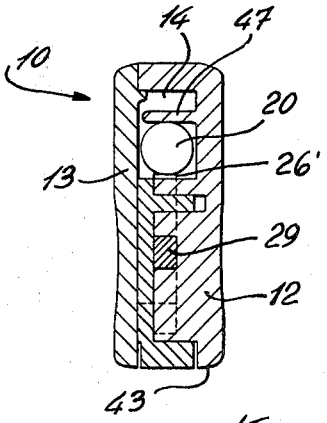
FIG. 3 is a section view along section lines 3—3 of FIG. 1.
Figure 4:
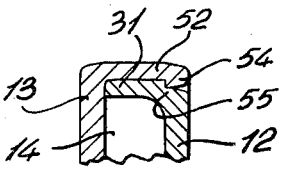
FIG. 4 is a section view showing a corner securement of the cover member with the base member in the direction of arrow 4.

Referring now to the drawings, and more particularly to FIGS. 1 to 5, there is shown generally 10, the key handle of the present invention secured to a key shaft 11. The housing has a base member 12 and a cover member 13 defining therebetween an internal chamber 14.

As shown more clearly in FIGS. 1 and 5, a switch member 15 is retained in the chamber 14 and is provided with a flexible guide means 16, herein constituted by two flexible arms 17 formed integral with the switch member 15 and which will be described more fully later. The switch member comprises essentially a key retention portion 18 and a finger actuable portion 19.

A miniature dry cell battery 20 is retained within the internal chamber 14 against a first contact element, here being the negative contact 21, which is provided with a lamp contact post 22 which is in electrical engagement with a negative terminal 23 (herein a first terminal) of a lamp 24.

As herein shown, the key shaft 11 is cut out of a standard key whereby to provide a connecting end 25 at a free end thereof. The connecting end comprises a pair of opposed retention arms 26 extending transverse to the longitudinal axis of the key shaft and extending outwardly of opposed side edges 27 thereof. One of the retention arms, namely arm 26′, constitutes a second conductive terminal which is positioned in contact with the socket 28 of the lamp which is the positive terminal. The conductive terminal also consists of a coextensive post-like extension 29 of the key shaft and protruding transversely to the retention arms 26 and 26′. The connecting end 25 of the key is positioned within the internal chamber 12 in a key shaft retention cavity portion and extends through a key port 30 formed in the front side wall 31 of the housing 10 with the opposed retention arms 26 and 26′ being in abutting engagement behind the front side wall 31 to each side of the key port 30. This position in the retention cavity portion is clearly indicated in FIG. 1.

The housing base member 12, cover member 13 and the switch member 15 are all moulded from a high memory plastic, acetal, material due to its ability to provide spring action. This is desirable due to the operation of various component parts of the switch member 15 and other elements in the base and cover members. The switch member 15 is moulded as a unitary part and the key retention portion 15 is provided with retention pins 32 protruding from a bottom surface thereof to each side of a neck cavity 33 whereby the extension portion 29 of the connecting end of the key shaft passes therethrough and is centrally aligned between both of the flexible guide arms 17. The retention pins engage in alignment holes 33 provided on a support ridge portion 34 formed in the forward end of the chamber 14 adjacent the port 30 whereby to maintain the extension portion 29 of the connecting end 25 elevated and in alignment with a second terminal 35 extending on the side edge of the battery 20. The negative terminal of the battery is provided on the bottom face 36 thereof and is in engagement with the negative contact element 21 which is held against the bottom wall 37 of the internal chamber 14 by means of the guide post 38 protruding transversely above the wall 37.

The guide post 38 is provided to locate the contact element 21 in proper position for electrical contact with the battery 20 and the negative terminal 23 of a lamp 24. As shown in FIG. 1, the guide post 38 also maintains the battery 20 captive between itself and the flexible fingers 17 and a battery engaging end 39 of the switch member 15.

Figure 5:
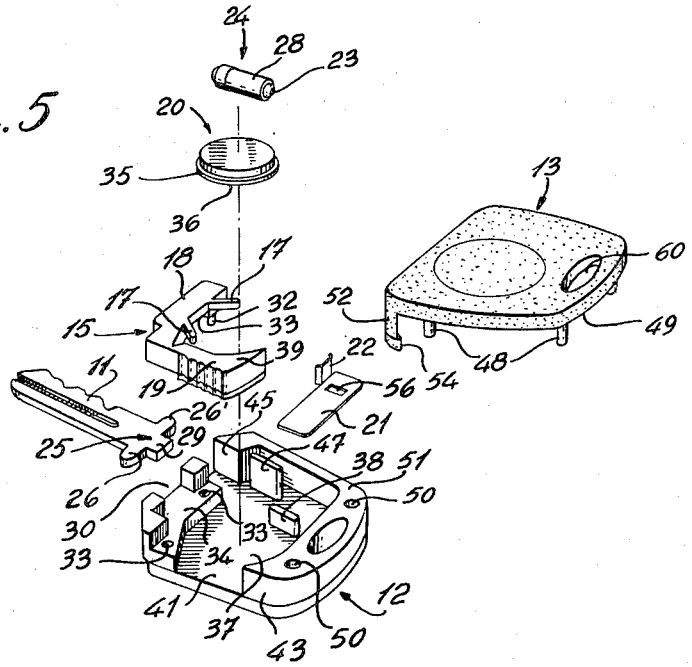
FIG. 5 is an exploded perspective view of the key handle and the key shaft showing the component parts thereof.
Figure 6:
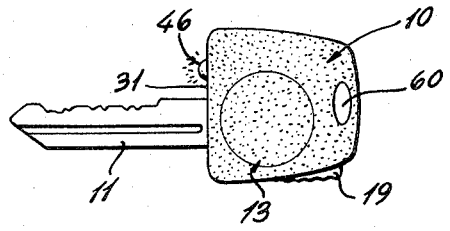
FIG. 6 is a plan view showing the key handle and the key shaft in its assembled condition.

As shown more clearly in FIGS. 1 and 5, the finger actuable portion 19 and the key retention portion 18 of the switch member 15 are interconnected by a flexible narrow joint 40 permitting the actuable portion 19 to be resiliently displaced with respect thereto. A switch receiving opening 41 is provided in a side wall of the base member 12 to receive the actuable portion 19 therein with an outside edge portion 42 of the actuable portion 19 protruding exteriorly of the side wall 43. By pressing the actuable switch portion 19 inwardly of the housing 10, it can be seen, with reference to FIG. 1, that the battery 20 will be displaced in the direction of the longitudinal axis 44 of the key shaft 44 against the resilient biasing action of the flexible fingers 17 which bias the battery 20 away from the extension portion 29 of the second contact element which is the free end of the key shaft 11. By depressing the finger actuable portion 19 inwardly, the battery side wall or second terminal 35 will make contact with the extension portion 29 and cause a closed circuit between the positive and negative terminals of the battery and the positive and negative terminals of the lamp thereby causing the lamp to light.

A lamp cavity 45 is formed in the front side wall 31 adjacent the port 30 through which the key shaft 11 extends whereby to permit the bulb portion 46 of the lamp 20 to protrude whereby to direct light in the direction of the shaft. The lamp socket 28 is frictionally held against the contact arms 26′ by a biasing post 47 protruding from the bottom wall 37 of the base member 12 and formed integrally therewith whereby to apply a transverse biasing force against the socket to retain it captive between it and the contact arm 26′. Also, the guide post 38 maintains the lamp contact post 22 in frictional contact with the negative terminal 23 of the lamp. Although the lamp cavity 45 is herein shown as extending parallel to the key shaft 11, it may be angulated slightly towards the shaft and this would require minor adjustments to the position of some of the elements coacting with the lamp to maintain electrical contact between the contact elements and the terminals.

As shown in FIG. 5, the cover member 13 is provided with depending alignment pins 48 depending from a bottom wall 49 thereof for alignment and securement of the cover in alignment holes 50 provided in the peripheral top wall 51 of the base member 12. Also, retention flanges 52 depend from each corner portion of the front edge 53 of the cover and overlap the corner front edges of the front wall 31 of the base member to interlock therewith. Interlocking is effected by providing a retention ridge 54 at the bottom edge of the flange and also forming a retention ridge 55 in the lower edge of the front wall 31. Thus, the cover member is rigidly secured to the base member.

In order to conveniently secure the key handle 10 in a key case or otherwise, an attachment hole 60 is provided near a top end wall thereof. Although the battery is herein shown as being a circular cell, other types of miniature batteries may be used by making slight and obvious alteration to some of the component parts of the key handle. Also, the connecting end 25 of the key shaft may be formed otherwise for retention within the key handle and still provide an electrical contact. The electrical contact 21 is stamped from a bronze metal. Also, the alignment slot 56 provided in the contact element 21 and the cross-section of the post 38 may be differently shaped to achieve the same purpose.

It is pointed out that the key handle and key shaft of the present invention provide a novel manner of key construction making it possible to adapt a key handle to different key shafts without the use of screws, glue, etc. The key shaft is retained in a "sandwich" manner in the key handle which is easily dismantleable and consists of very few parts.

It is within the ambit of the present invention to cover any further obvious modifications of the example of the preferred embodiment described herein, provided such modifications fall within the scope of the appended claims.

I claim:

1. A key handle comprising a housing for securement to a key shaft, said housing having a base and a cover member defining an internal chamber therebetween, a key shaft retention cavity defined between said base and cover member to removably retain a connecting end of said key shaft, a switch member formed as a unitary molded part and retained in said chamber, said switch member having two spaced apart outwardly extending flexible arms to bias a flat circular dry cell battery to a first position in said chamber with a first flat wall terminal of said battery lying against a contact element which is in electrical contact with a first terminal of a lamp retainable in said chamber to direct light outwardly of said housing in the direction of said key and further maintaining a circumferential terminal of said battery away from a further contact element in contact with a second terminal of said lamp, said further contact element being said connecting end of said key secured in said housing and centrally aligned between said flexible arms, said connecting portion having a contact portion spaced from said battery and a lamp engaging portion in contact with said second terminal of said lamp, said switch member having an actuable portion accessible from the exterior of said housing to displace said battery in its flat horizontal plane against the biasing force of said flexible guide means whereby said circumferential terminal of said battery is positioned in electrical contact with said further contact element to cause an electric current to flow through said lamp and cause it to light.

2. A key handle as claimed in claim 1 wherein said actuable portion being integrally molded with said key retention portion and interconnected by a flexible joint, said housing having a switch receiving opening in a side wall thereof with a finger actuable edge of said actuable portion protruding outwardly therefrom, said actuable portion further having a battery engaging end disposed in said chamber and engageable with said battery to displace said battery in its flat horizontal plane towards said conductive terminal end of said key.

3. A key handle as claimed in claim 2 wherein a guide post is provided in said chamber to maintain said battery captive between itself and said flexible arms and battery engaging end of said switch member.

4. A key handle as claimed in claim 2 wherein a guide post is provided in said chamber to locate said contact element for electrical contact with said first terminal of said lamp and said first flat wall terminal of said battery, said guide post also maintaining said battery captive between itself and said flexible arms and battery engaging end of said switch member.

5. A key handle as claimed in claim 2 wherein said key retention portion is provided with retention pins to engage in said base to retain said connecting end of said key therein.

6. A key handle as claimed in claim 5 wherein said connecting end comprises a pair of opposed retention arms extending transverse to the longitudinal axis of said key shaft and extending outwardly of opposed side edges thereof, one of said retention arms constituting part of said conductive terminal, said conductive terminal also being a coextensive post-like extension of said key shaft protruding transversely of said retention arms, said key extending through a key port in a front side wall of said housing with said opposed retention arms being in abutting engagement behind said front side wall to each side of said key port.

7. A key handle as claimed in claim 6 wherein a lamp cavity is formed in said front side wall, said lamp being frictionally held in said chamber by a biasing post formed of resilient material to apply a transverse biasing force against a socket of said lamp whereby said lamp is rigidly held between said retention arm portion of said conductive terminal of said key and said biasing post, said socket constituting said second terminal of said lamp, said lamp extending in said lamp cavity to direct light in the direction of said key.

8. A key handle as claimed in claim 1 wherein said chamber is formed in said base, said cover being a flat cover member having depending alignment pins securable in alignment holes provided in a top circumferential wall of said base, at least one retention flange depending from said cover and releasably engageable with a retention ridge of said base.

* * * * *